US009140005B2

(12) United States Patent
Miller

(10) Patent No.: US 9,140,005 B2
(45) Date of Patent: Sep. 22, 2015

(54) SELF-ALIGNING CORNER BEAD FOR FIREPROOFING STRUCTURAL STEEL MEMBER AND METHOD OF USING SAME

(71) Applicant: Philip Glen Miller, Lake Charles, LA (US)

(72) Inventor: Philip Glen Miller, Lake Charles, LA (US)

( * ) Notice: Subject to any disclaimer, the term of this patent is extended or adjusted under 35 U.S.C. 154(b) by 0 days.

(21) Appl. No.: 14/292,881

(22) Filed: May 31, 2014

(65) Prior Publication Data

US 2014/0352243 A1 Dec. 4, 2014

Related U.S. Application Data

(60) Provisional application No. 61/830,257, filed on Jun. 3, 2013.

(51) Int. Cl.
*E04B 1/94* (2006.01)
*E04F 13/06* (2006.01)

(52) U.S. Cl.
CPC . *E04B 1/944* (2013.01); *E04B 1/94* (2013.01); *E04B 1/948* (2013.01); *E04F 2013/063* (2013.01); *Y10T 428/1241* (2013.01)

(58) Field of Classification Search
CPC ..... E04B 1/94; E04B 1/944; E04B 1/948; E04B 2/845; E04F 2013/063; E04F 13/06; E04F 13/04; E04F 13/047; Y10T 428/1241
USPC ..... 52/287.1, 288.1, 741.3, 254, 255, 256, 52/443, 454, 423, 344, 358, 361; 249/211, 249/50
See application file for complete search history.

(56) References Cited

U.S. PATENT DOCUMENTS

| | | | | | |
|---|---|---|---|---|---|
| 658,386 | A | * | 9/1900 | Mitchell | 52/257 |
| 1,210,560 | A | * | 1/1917 | Tappen | 52/647 |
| 1,419,232 | A | * | 6/1922 | Curtis | 52/255 |
| 1,608,475 | A | * | 11/1926 | Dean | 52/255 |
| 1,858,836 | A | * | 5/1932 | Martell | 52/647 |
| 1,988,081 | A | * | 1/1935 | Kemper | 52/647 |
| 2,005,572 | A | * | 6/1935 | Vass | 52/85 |
| 2,012,203 | A | * | 8/1935 | Peterson | 52/255 |
| 2,213,603 | A | * | 9/1940 | Young et al. | 52/344 |
| 2,370,052 | A | * | 2/1945 | Lindelow | 52/361 |
| 2,465,756 | A | * | 3/1949 | Schepis | 52/361 |
| 2,702,932 | A | * | 3/1955 | Woodson | 249/188 |
| 2,945,329 | A | * | 7/1960 | Schneller | 52/712 |
| 3,175,330 | A | * | 3/1965 | Holsman | 52/255 |
| 3,217,456 | A | * | 11/1965 | Quigg et al. | 52/423 |
| 3,345,788 | A | * | 10/1967 | Holsman | 52/254 |
| 3,412,512 | A | * | 11/1968 | Hollister | 52/239 |
| 3,516,213 | A | * | 6/1970 | Sauer | 52/834 |
| 3,772,844 | A | * | 11/1973 | Thorne | 52/741.3 |
| 3,908,327 | A | * | 9/1975 | Quigg | 52/834 |

(Continued)

*Primary Examiner* — Brent W Herring
(74) *Attorney, Agent, or Firm* — Shannon, Gracey, Ratliff & Miller

(57) ABSTRACT

A self-aligning corner bead for fireproofing structural steel, having a strip of welded wire fabric cut to the appropriate width for the fireproofing thickness and bent longitudinally to form an obtuse V-shaped device is disclosed. A plastic nosing is installed along one edge. A method of finishing the corners for fireproofing of structural steel member using an improved corner bead includes the step of attaching the first wing of an obtuse V-shaped device through a lathe to the structural steel member utilizing pneumatic or screw type fasteners. The mesh structure of the second wing of the V-shaped device provides a dam to form a roughened surface on the first application of fireproofing material until it hardens.

19 Claims, 6 Drawing Sheets

(56) References Cited

U.S. PATENT DOCUMENTS

| | | | | | |
|---|---|---|---|---|---|
| 3,913,290 | A | * | 10/1975 | Billing et al. | 52/347 |
| 4,069,075 | A | * | 1/1978 | Billing et al. | 156/82 |
| 4,391,074 | A | * | 7/1983 | Holsman | 52/367 |
| 4,683,019 | A | * | 7/1987 | Motoki | 156/293 |
| 4,955,173 | A | * | 9/1990 | Czechowski | 52/834 |
| 5,398,472 | A | * | 3/1995 | Eichelkraut | 52/443 |
| 5,433,991 | A | * | 7/1995 | Boyd et al. | 428/193 |
| 5,580,648 | A | * | 12/1996 | Castle et al. | 442/21 |
| 5,625,986 | A | * | 5/1997 | Mansfield et al. | 52/255 |
| 5,685,116 | A | * | 11/1997 | Bradshaw et al. | 52/311.1 |
| 5,788,403 | A | * | 8/1998 | Dison et al. | 403/397 |
| 6,591,566 | B1 | * | 7/2003 | Rodlin | 52/311.1 |
| 7,921,537 | B2 | * | 4/2011 | Rodlin | 29/464 |
| 8,555,593 | B2 | * | 10/2013 | Ramos | 52/489.1 |
| 2004/0250488 | A1 | * | 12/2004 | Rodlin | 52/415 |
| 2007/0119106 | A1 | * | 5/2007 | Sacks et al. | 52/255 |
| 2012/0085047 | A1 | * | 4/2012 | Hiscock et al. | 52/287.1 |

* cited by examiner

PRIOR ART - CONTOUR METHOD

PRIOR ART - HOLLOW BOX METHOD

SELF-ALIGNING CORNER BEAD FOR FIREPROOFING STRUCTURAL STEEL MEMBER AND METHOD OF USING SAME

CROSS-REFERENCE TO RELATED APPLICATIONS

This application claims priority to U.S. Provisional Patent Application No. 61/830,257, entitled "SELF-ALIGNING CORNER BEAD FOR FIREPROOFING STRUCTURAL STEEL AND METHOD THEREOF," filed Jun. 3, 2013, the disclosure of which is hereby incorporated herein by reference.

TECHNICAL FIELD

The present invention relates generally to a corner bead for cementitious fireproofing of structural steel members and, more particularly, to a device that is self-aligning in installation and allows the accurate gauging of the thickness of the fireproofing material along two surfaces.

BACKGROUND OF THE INVENTION

In the art of a corner bead for fireproofing structural steel, prior approaches conventionally comprise a v-bend "plastic nose corner bead" having adjustable legs (flanges). This type of corner bead is mostly used in the plastering and stucco trades. The previously utilized corner bead is constructed of wires welded into a lattice that is v-shaped in section as shown in FIG. 1.

In installation, the longitudinal base wires of the v-shaped corner bead are attached with a tie wire either onto a metal lath or onto a wire mesh, and further attached to the steel member to be fireproofed as shown in FIGS. 2 and 3. To establish the correct fireproofing thickness, one must establish the correct height of the vertex by shrinking or expanding the distance between the legs (flanges) of the corner bead defined by the vertex. Using this technique, the alignment of the corner bead with the adjacent surface is difficult and great skill is required to install the corner bead for fireproofing structural steel.

Accordingly, the need exists for an improved corner bead to avoid inaccuracy in gauging the thickness of the fireproofing material and to allow easy installation. The improved corner bead is inexpensive to manufacture and easy to install.

SUMMARY OF THE INVENTION

The aim of the present invention is to provide a self-aligning corner bead which allows to make, in an accurate and quick manner, corners of the fireproofing material around structural steel members, said fireproofing material having uniform thickness around the structural steel. This aim is achieved owing to the fact that a strip of welded wire fabric having pre-determined width is bent along its longitudinal axis forming two wings of the desired width. The width of the second wing as well as the angle at which the two wings meet along the longitudinal axis determine the thickness of the fireproofing material strip disposed around the structural steel member along two surfaces. The uniformity in thickness of the fireproofing material distributed around the structural steel member is achieved by using the same width of the second wing bent at the same angle in relation to the first wing for all utilized corner beads, whether in a contour or a hollow-box type application.

It is further an object of the present invention to provide an improved corner bead for fireproofing structural steel without the need of adjusting the legs.

Another object of the present invention is to provide novel means of installation of the corner bead by easier attachment to the structural steel.

Another object of the present invention is to provide an improved technique for application of accurate thickness of fireproofing material along two surfaces under any construction condition for making said fireproofing of structural steel members.

A further object of the present invention is to provide a dam to form a roughened surface on the first application of fireproofing material until it hardens.

In satisfaction of these and related objectives, applicant's present invention provides an improved corner bead for fireproofing structural steel which is very competitive from a mere economic standpoint. The corner bead of the present invention consists of a strip of welded wire fabric cut to the appropriate width for the fireproofing thickness and bent longitudinally to form an obtuse V-shaped device.

In accordance with the present invention, the corner bead includes an elongated strip of welded wire fabric of predetermined width, said strip bent along its longitudinal axis to define a pair of laterally extending wings, said wings comprising a flexible mesh strip.

According to one embodiment of the present invention, the improved corner bead allows each wing of the corner bead to perform different functions that are essential for the successful completion of the fireproofing process along two surfaces.

The width of the first wing provides a flat portion of metal grid (mesh) through which pneumatic or screw type fasteners attach the mesh to the lath disposed over the structural steel at the appropriate location. This easy application establishes automatic alignment and eliminates the cumbersome process of shrinking or expanding the distance between the legs of the traditional bead.

The width of the second wing and/or the angle at which the first and the second wing meet determines the thickness of the fireproofing material along two surfaces. The location of the rigid screed edge along the plastic nosing allows the correct amount of material to be distributed alongside the corner bead creating a leveled application throughout the surface.

The width of the second wing also provides a dam to form a roughened surface on the first application of the fireproofing material until it hardens. This forming action allows successive application of the cement material to the adjacent surface.

In another aspect, the present invention resides in a method of manufacturing an improved corner bead for fireproofing structural steel comprising a strip of welded wire fabric cut to the appropriate width for the fireproofing thickness and bent along the longitudinal axis to form an obtuse V-shaped device, said longitudinal axis to define a pair of wings extending laterally therefrom at an angle of approximately more than 90 disagrees but less than approximately 180 degrees relative to each other and, wherein said first wing is secured to a structural steel member through a lath, said lath disposed around the structural steel member to hold the fireproofing material to said structural steel member, and a second wing configured to establish a desired thickness of the fireproofing material along two surfaces by providing a rigid screed edge along the plastic nosing.

In a further aspect, the present invention resides in a method of finishing the corners for cementitious fireproofing (whether in a hollow box or a contour application) of structural steel members, the method comprising: selecting a corner bead comprising a strip of welded wire fabric cut to the appropriate width for the fireproofing thickness and bent along its longitudinal axis to form an obtuse V-shaped device, said longitudinal axis to define a pair of wings extending laterally therefrom at an angle of approximately more than 90 degrees but less than approximately 180 degrees relative to each other; said first wing attached by joining means (attachment means) for securing said corner bead's first wing to a lath or mesh previously attached to a structural steel member and a second wing configured to establish a desired thickness of the fireproofing material along two surfaces by providing a rigid screed edge along the plastic nosing; attaching said first wing through said lath to the structural steel member; and applying successive layers of the fireproofing material to allow creation of the roughened cementitious surface, and tapering to the outward extending width of the second wing.

Applicant's approach to the problem described above is certainly simple, but it is equally unobvious. With over twenty years of experience in the field of fireproofing services, applicant is well educated on the challenges involved such as the difficulty of properly adjusting the traditional corner bead to the adjacent surface, the uneven application of fireproofing material, and the lack of dam for the wet cement material. Despite these well-known and long-existing problems, and a readily apparent market for a solution, no one has presented a viable, cost-effective solution such as applicant here provides.

DETAILED DESCRIPTION OF THE INVENTION

Figure 1:
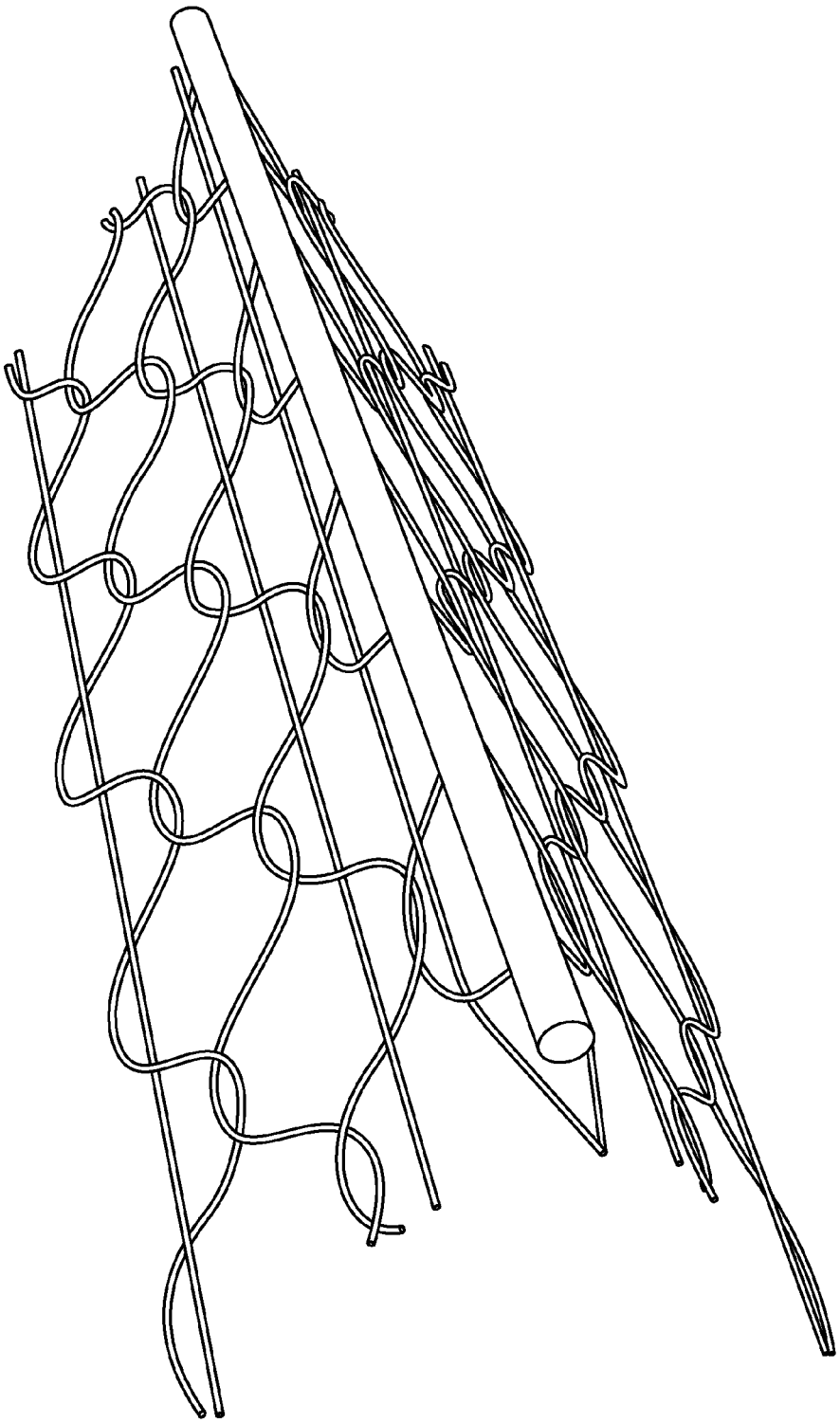
FIG. 1 (Prior Art)
FIG. 1 is a perspective view of a small section of the corner bead according to prior art.
Figure 2:
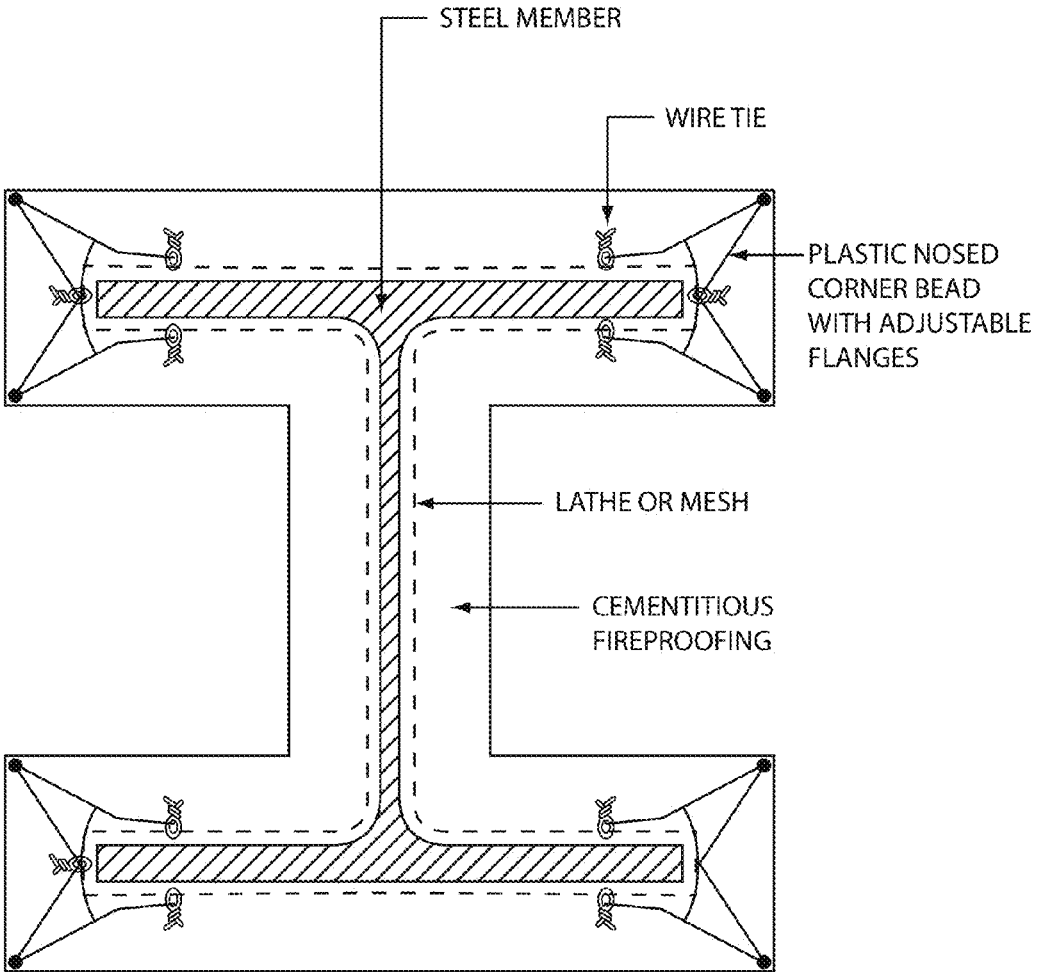
FIG. 2 is a cross-sectional schematic view of the fireproofing structure utilizing prior art corner bead and installed according to the contour method.
Figure 3:
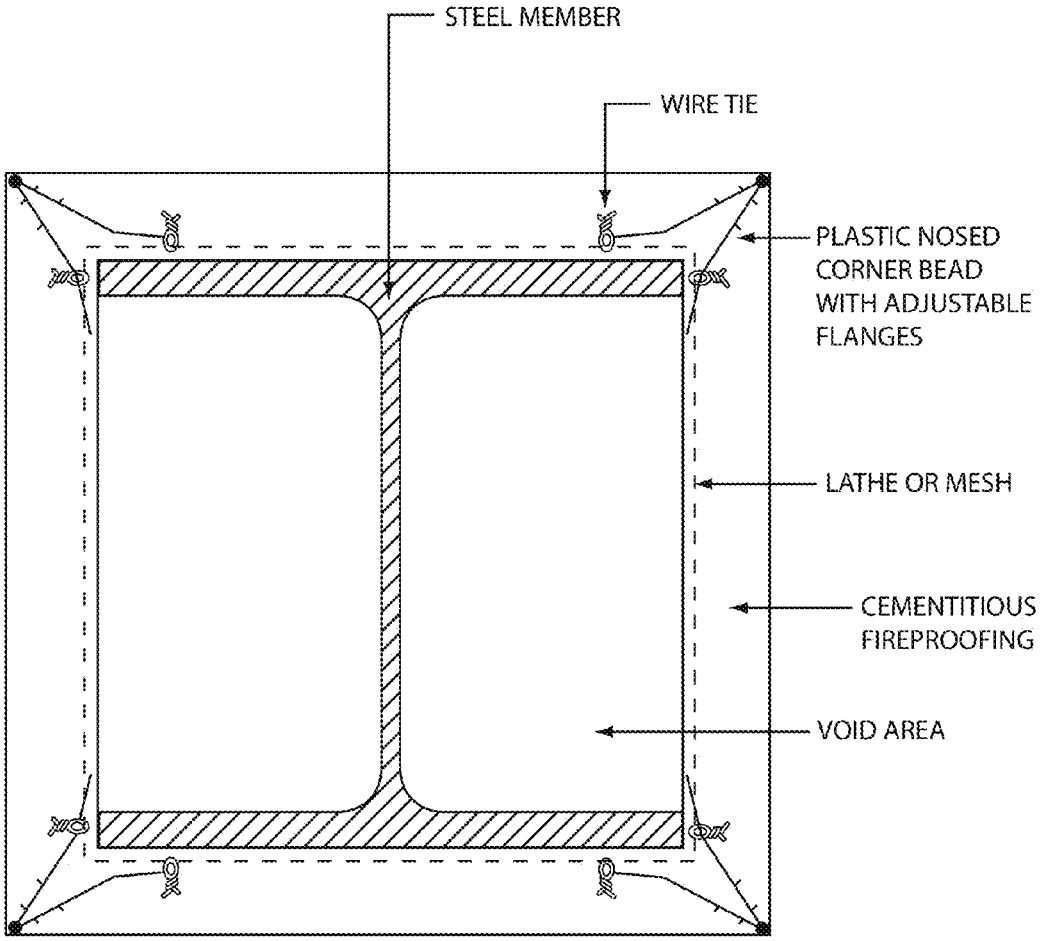
FIG. 3 is a cross-sectional schematic view of the fireproofing structure utilizing prior art corner bead and installed according to the hollow-box method.
Figure 4:
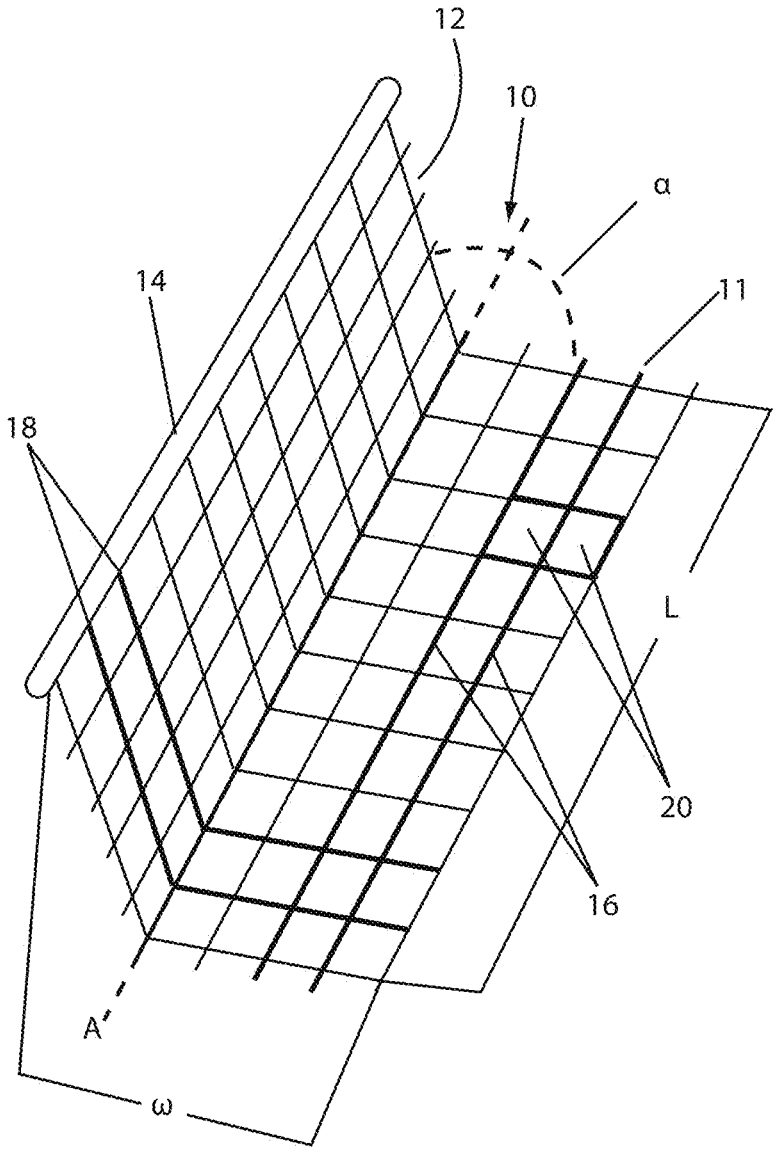
FIG. 4 is a perspective view of a small section of the corner bead manufactured according to one of the embodiments of the present invention.

FIG. 4 shows a corner bead structure comprising a strip of welded wire fabric 10 cut to the appropriate length L and width W for the fireproofing thickness and bent longitudinally to form a structure having a longitudinal axis A, said longitudinal axis to define a first wing 11 and a second wing 12, said first wing 11 and said second wing 12 forming an angle $\alpha$ of approximately more than 90 degrees but less than approximately 180 degrees. The second wing's outer edge comprises a substrate forming a nose 14, said nose 14 together with the second wing 12 providing a rigid edge of dam-like functionality.

As further shown in FIG. 4, the corner bead structure (typically 16 gauge welded wires) comprises a plurality of longitudinal metal ribs 16 arranged in substantially parallel fashion to the longitudinal axis A and to each other and the plurality of transverse metal ribs 18 disposed between and extending substantially perpendicular to the longitudinal axis A and the longitudinal metal ribs 16. A plurality of void areas 20 of the approximate size 0.5"×0.5" are disposed between the longitudinal ribs 16 and the transverse ribs 18, such that each said void area 20 is bounded by at least two longitudinal ribs 16 and at least two transverse ribs 18.

Figure 5:
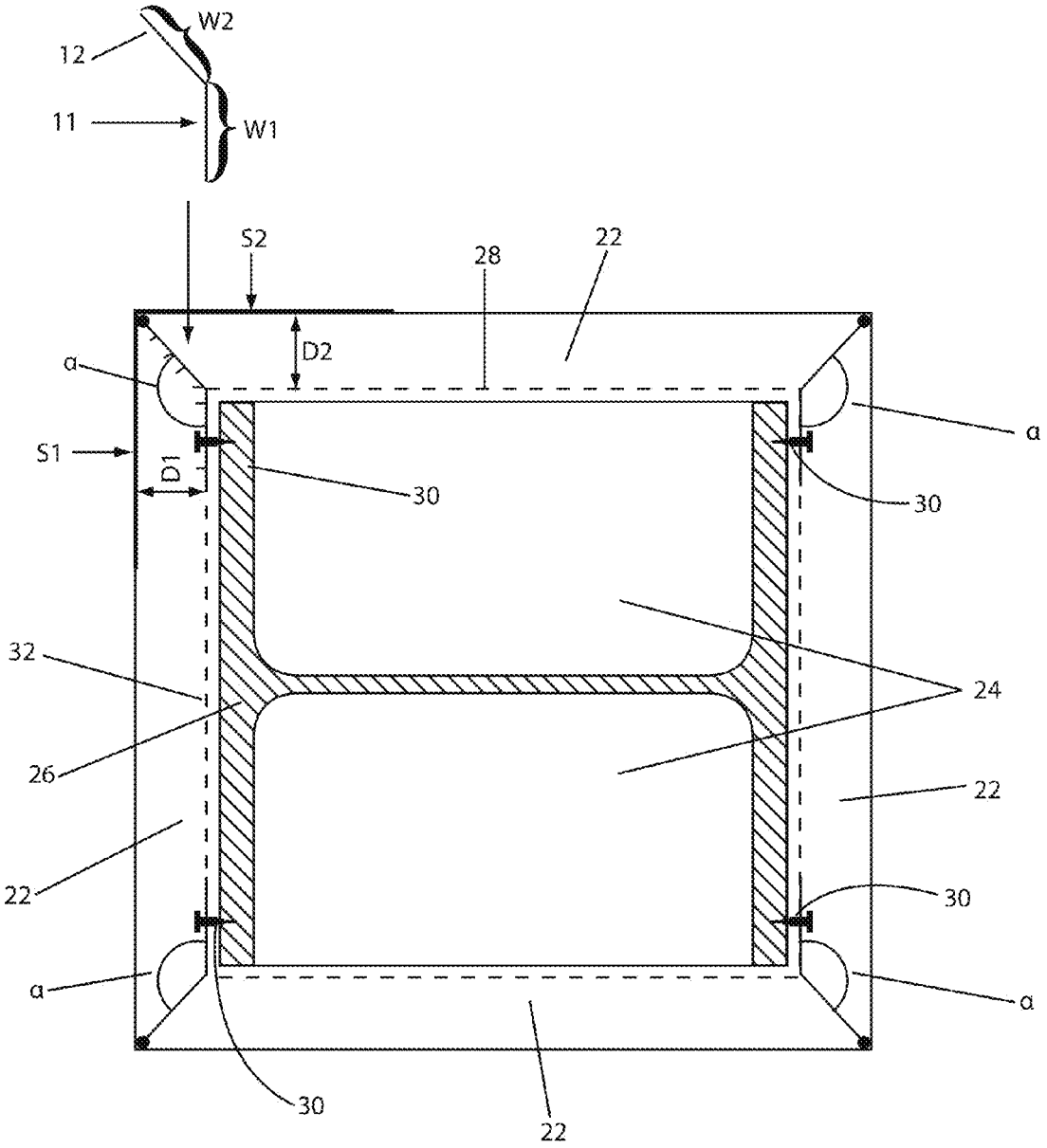
FIG. 5 is a cross-sectional schematic view of the fireproofing structure utilizing a corner bead of the present invention according to the hollow-box method.

In general, two methods of enveloping the structural steel member with the fireproofing material may be utilized. As shown in FIG. 5, the cementitious fireproofing material 22 surrounds the dimensions of the structural steel in a hollow-box manner, leaving empty void areas 24 between the structural steel member 26.

Figure 6:
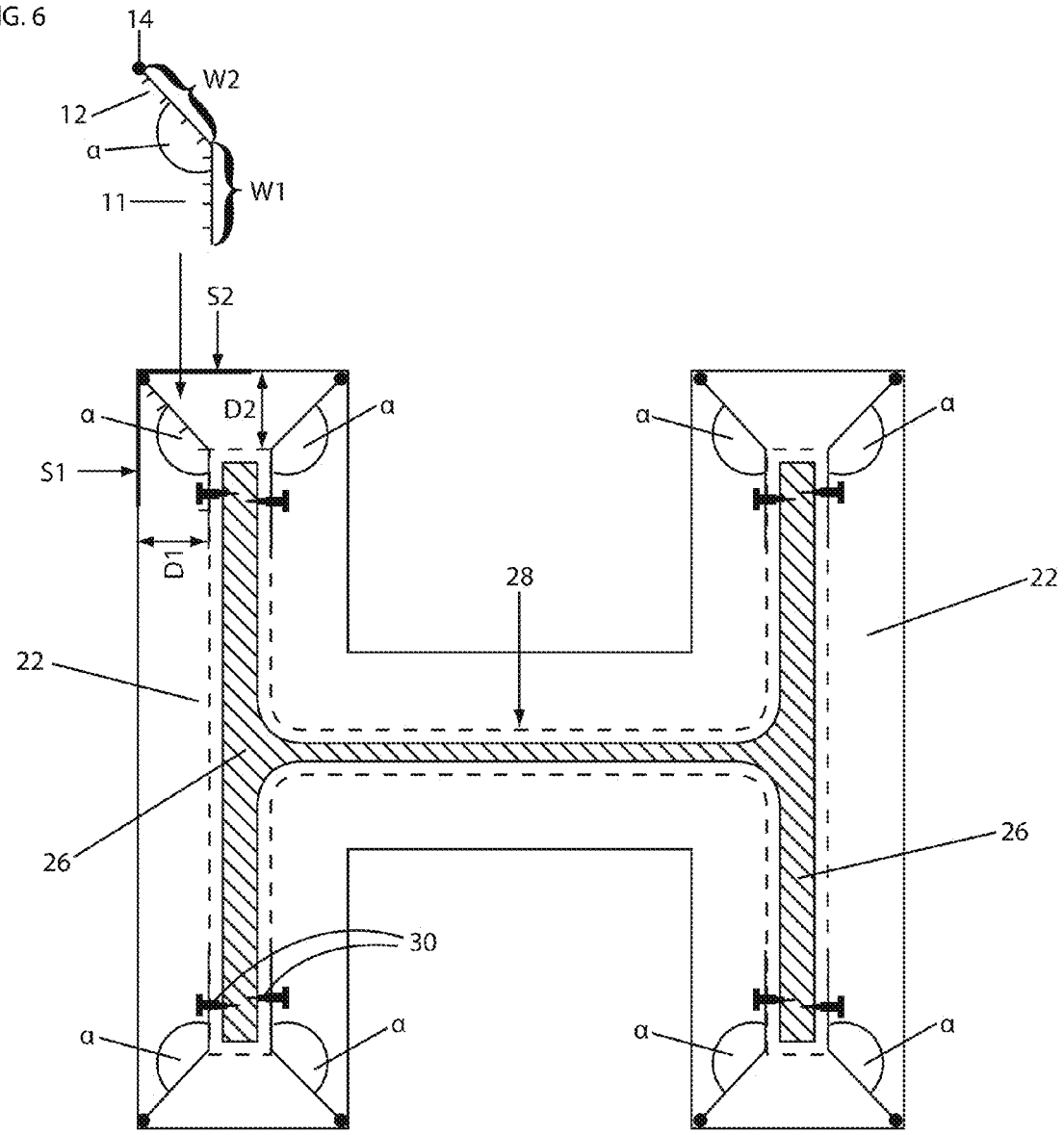
FIG. 6 is a cross-sectional schematic view of the fireproofing structure utilizing a corner bead of the present invention according to the contour method.

As shown in FIG. 6, the cementitious fireproofing material 22 surrounds the dimensions of the structural steel member 26 in a contour-like manner, tracing the structural steel member 26 in all its dimensions.

As can be seen most clearly in FIGS. 5 and 6, the second width W2 of a second wing 12 determines the distances (D1 and D2) between the lath 28 disposed over the structural steel member 26 and the two planar surfaces, S1 and S2 forming a corner of the fireproofing material 22 disposed around the structural steel member 26. Similarly, the distances, D1 and D2, may be altered by changing an angle $\alpha$ at which the strip of the welded material with pre-determined width W is bent along its longitudinal axis A. For example, the smaller (less obtuse) the angle $\alpha$ between the first wing 11 and the second wing 12, the longer is the distance D1 between the lath 28 and the surface S1, and the shorter is the distance D2 between the lath 28 and the surface S2. Consequently, such change in the angle causes the strip of the fireproofing material 22 to be thicker along surface S1 in relation to the thickness of the fireproofing strip 22 along surface S2.

In a further development of the subject matter described with reference to FIGS. 4, 5, and 6, the first wing 11 is attached through the lath 28 into the structural steel member by the pneumatic fastener 30. Other contemplated joining (attaching) means are welded pins or screws. The second wing 12 along with the plastic nose 14 attached to the outer edge of the second wing 12 serves as a dam during the process of fireproofing. The fireproofing material is then sprayed onto the lath 28 and screeded off using the plastic nose's 14 location to determine the finished thickness of the fireproofing material.

In a shop application (i.e., fireproofing is applied in a facility of the applicant to individual steel members), the cementitious composition is sprayed or poured one at a time on one horizontal surface 32 of lath 28 as shown in FIG. 5. The steel member 26 is then rotated 90 degrees and the adjacent surfaces become horizontal to allow easy application of the fireproofing material. With this process in place, each successive spraying is performed which allows hardening of the fireproofing material before the next rotation of the steel member. This is why the dam-like functionality of the corner bead according to one embodiment of the present invention is critical as it provides an appropriate keying surface to bond the subsequent layers of the fireproofing material. Each steel member is turned four times to uniformly apply the cementitious material to all surfaces.

In a field application (outside of applicant's facility), where the members are erected into a structure prior to fireproofing, all surfaces of the steel member may be sprayed or troweled onto the lath surfaces at the same time (not shown). The process is similar regardless of whether the contour or hollow-box application is utilized.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in acclaimed structure or method.

What is claimed is:

1. A self-aligning corner bead for fireproofing a structural steel member along two adjoining surfaces, said corner bead comprising:

a strip of welded wire fabric having a pre-determined width and being longitudinally aligned with said structural steel member, said strip being bent along its longitudinal axis thereby defining a first wing and a second wing, each wing forming an angle between approximately 90 degrees and 180 degrees;

wherein the strip is only fastened to the structural steel member at one or more fastening positions of the first wing;

wherein an outer edge of said second wing comprises a substrate positioned along said outer edge, said substrate operable to receive a fireproofing material;

wherein said corner bead terminates at the outer edge of said second wing, said second wing being substantially planar; and wherein a second width of said second wing and said angle formed between the wings determine a uniform thickness of the fireproofing material of said structural steel member.

2. The corner bead of claim 1, wherein said angle is approximately 135 degrees.

3. The corner bead of claim 1, wherein said first wing has a first width, and wherein a nose is formed on a tip of the outer edge of said second wing.

4. The corner bead of claim 3, wherein said first wing is attached to said structural steel member through a lath, said lath being disposed over said structural steel member.

5. The corner bead of claim 1, wherein said strip of said welded wire fabric further comprises:

a plurality of longitudinal metal ribs arranged in substantially parallel fashion, a plurality of transverse metal ribs disposed between and extending substantially perpendicular to the longitudinal metal ribs, and a plurality of void areas disposed between the longitudinal ribs and the transverse ribs, wherein each said void area is bounded by at least two longitudinal ribs and at least two transverse ribs.

6. The corner bead of claim 1, wherein said longitudinal axis is a middle axis.

7. The corner bead of claim 1, wherein either or both of the first and second wings comprise a flexible mesh strip.

8. The corner bead of claim 7, wherein the first wing forms a substantially flat portion of a metal grid through which a pneumatic fastener secures the metal grid to a lath positioned over the structural steel member at one of the fastening positions.

9. The corner bead of claim 1, wherein the angle is adjustable.

10. A method of finishing at least two corners of a structural steel member with a fireproofing material, said method comprising:

assembling a plurality of self-aligning corner beads, each corner bead comprising a strip of welded wire fabric of a pre-determined width, longitudinally aligning a longitudinal axis of each corner bead with said structural steel member to cause the fireproofing material to have a uniform thickness, said longitudinal axis defining a first wing and a second wing;

fastening the strip of each corner bead to the structural steel member only at one or more fastening positions of the first wing;

bending said strip along its longitudinal axis, an angle being formed between each respective wing of between approximately 90 degrees and 180 degrees, and wherein a substrate is positioned along an outer edge of said second wing that is operable to receive the fireproofing material;

said corner bead terminating at the outer edge of said second wing, said second wing being substantially planar; and applying a first layer of said fireproofing material onto a lath, said lath disposed on each side forming said at least two corners of said structural steel member.

11. The method of claim 10, further comprising:

forming a nose along the substrate of the outer edge; and applying successive layers of the fireproofing material to form a roughened cementitious surface.

12. The method of claim 11, further comprising: tapering to an outward extending width of said second wing.

13. A method of fireproofing a structural steel member along two surfaces, said method comprising:

assembling a length of corner bead comprising a strip of welded wire fabric having a pre-determined width, bending said strip longitudinally to form an obtuse V-shaped device having a longitudinal axis, said longitudinal axis defining a first wing and a second wing, wherein an angle is formed between each wing of between approximately 90 degrees and 180 degrees, and wherein an outer edge of said second wing comprises a substrate positioned along said outer edge, said substrate operable to receive a fireproofing material;

said corner bead terminating at the outer edge of said second wing, said second wing being substantially planar;

attaching the strip to the structural steel member only at one or more fastening positions of said first wing; and applying the fireproofing material onto a lath disposed on each said two or more surfaces to form a corner of said structural steel member.

14. The method of claim 13, wherein said second wing has a second width and a nose formed on the substrate, said second width gauged to a desired thickness of said fireproofing material, and wherein either or both of the first and second wings comprise a flexible mesh strip.

15. The method of claim 14, wherein the first wing forms a substantially flat portion of a metal grid through which a pneumatic fastener secures the metal grid to a lath positioned over the structural steel member at a predetermined location, wherein said angle determines a desired thickness of said fireproofing material disposed along said two surfaces.

16. A fireproofing steel structure, said structure comprising:

a structural steel member;

a plurality of self-aligning corner beads, each corner bead comprising a strip of welded wire fabric having a predetermined width and being longitudinally aligned with said structural steel member, said strip being bent along its longitudinal axis, said longitudinal axis defining a first wing and a second wing, each wing forming an angle of between approximately 90 degrees and 180 degrees;

wherein the strip is only fastened to the steel member at one or more fastening positions of the first wing;

wherein an outer edge of said second wing comprises a substrate positioned along said outer edge said substrate operable to receive a fireproofing material;

wherein said corner bead terminates at the outer edge of said second wing, said second wing being substantially planar; and wherein a second width of said second wing and said angle between formed between the wings determine a desired uniform thickness of the fireproofing material for said structural steel member.

17. The structure of claim 16, said fireproofing material enveloping said structural steel member.

18. The structure of claim 16 further comprising a lath, said lath disposed around said structural steel member.

19. The structure of claim 18 further comprising one or more fasteners at the one or more fastening positions between said lath and said first wing, said fasteners operatively coupling said lath and first wing to each other.

* * * * *